United States Patent [19]

Frydenberg

[11] Patent Number: 4,576,307

[45] Date of Patent: Mar. 18, 1986

[54] SEPARABLE ELEMENTS HELD TOGETHER BY A SLIDING LATCH

[75] Inventor: Donald V. Frydenberg, Arlington, Tex.

[73] Assignee: Doskocil Manufacturing Co., Inc., Arlington, Tex.

[21] Appl. No.: 568,387

[22] Filed: Jan. 5, 1984

[51] Int. Cl.[4] ..... B65D 45/16

[52] U.S. Cl. ..... 220/324; 24/437; 190/117; 190/119; 220/4 E; 220/94 A; 220/343; 292/302; 292/DIG. 50; 383/69

[58] Field of Search ..... 220/343, 324, 4 E, 94 A; 150/123; 383/62, 64, 69; 190/119, 121, 120, 117; 292/302, DIG. 50; 24/621, 622, 598, 652, 437

[56] References Cited

U.S. PATENT DOCUMENTS

| | | | |
|---|---|---|---|
| 631,532 | 8/1899 | Schmitt | 383/69 |
| 1,085,115 | 1/1914 | Ebert | 383/69 |
| 1,878,413 | 9/1932 | Leberman | 292/DIG. 50 |
| 2,074,133 | 3/1937 | Rodin | 292/302 |
| 2,762,076 | 9/1956 | Kiba | 220/343 |
| 3,493,102 | 2/1970 | Belokin, Jr. | 312/215 |
| 3,710,761 | 1/1973 | Gregory | 220/4 E |
| 4,048,051 | 9/1977 | Gretz | 220/324 X |

*Primary Examiner*—Allan N. Shoap

*Attorney, Agent, or Firm*—Charles W. McHugh

[57] ABSTRACT

A molded plastic container has first and second portions which are relatively movable between open and closed configurations; and the two portions have first edges which are juxtaposed when the portions are closed. A T-shaped rail is fixed to the first edge of one of the container portions, and the rail extends along said edge for a significant length—except for a location where it is interrupted by two adjacent gaps. A pair of posts are fixed to the first edge of the second container portion, and the posts are positioned so as to be insertable into the two rail gaps when the two container portions are in their closed configuration. The posts have a transverse configuration which matches the transverse configuration of the rail, so that the posts may be described as forming geometric extensions of the rail when the two container portions are closed. A slide has an interiorly facing opening which is sized for engaging the rail and for being captured thereby. The slide has a first position at which the pair of posts are free to move transversely with respect to the rail, such that the two container portions may be opened; and the slide has a second position at which it completely envelops the two posts and at least a portion of the rail. In its second position the slide precludes opening of the container by virtue of preventing transverse movement of the posts with respect to the rail.

10 Claims, 13 Drawing Figures

SEPARABLE ELEMENTS HELD TOGETHER BY A SLIDING LATCH

This patent contains subject matter which is related to the Patentee's U.S. Pat. No. Des. 278,189 entitled "Case for a Gun or the Like" which issued on Apr. 2, 1985.

BACKGROUND OF THE INVENTION

This invention relates generally to techniques for selectively joining and holding together two separable elements with a sliding fastener; more specifically, it relates to a container with a hinged lid and a simplified latching mechanism which utilizes an elongated rail and a longitudinally movable slide.

There are many occasions when it is desirable to bring together two separable elements and hold them in a joined condition—while preserving the opportunity of releasing the elements with ease at any desired time. One example of this kind of situation exists when a hinged lid is brought into contact with the opening of a container, and the lid is to be secured so that the container is said to be closed. As a specific example of such a container, a so-called hard case for shotguns, rifles, fishing rods, pool sticks, etc., is often a necessity when someone wants to safely transport or store whatever object will fit within the container. In such situations, it naturally will be desirable that the container not consume an inordinate amount of space—or create an unfavorable weight penalty if the object is to be shipped by air freight or the like. Too, if a group of hunters or fishermen are transporting all of their gear in the trunk of an automobile or back of a van, it will be preferable that both space consumption and total weight be minimized—at the same time that the gear is being protected against adverse weather or damage from relative movement against adjacent structures, etc.

When the objects to be protected by a container are as long as a rifle, the container will typically be at least 48 inches long. If such a container is to be built up from a material like plywood (with a reinforcing frame) or a metal such as aluminum, it will typically weigh several (e.g., about 10) pounds. While such a weight may not seem like very much in an absolute sense, it would be desirable to reduce the basic weight of the container—if only weight reduction did not introduce a problem of reduced strength. That is, it would be nice to have tough containers that had a low weight which more nearly approached the weight of cloth or soft cases, while still offering at least some of the protection which is provided by an absolutely rigid case. One way of accomplishing this goal would be to use light-weight materials such as impact-resistant polypropylene, and to mold such a material into relatively large pieces, preferably constituting at least one-half of a case. And, with proper design, a single die can be fabricated in order that two consecutive parts that are molded from the same die can be positioned face-to-face (with one of the parts, of course, being reversed with respect to the other) in order to define a closed compartment between the two parts. By connecting the confronting parts with a hinge along one side and providing a latching mechanism along the other side, the two parts can produce a compartment that is easily opened but which is securely held in its closed configuration when desired. Accordingly, it is an object of this invention to provide a container of the described type, and to do so in a manner which fosters economy in manufacture and convenience in use, but which also produces an attractive appearance.

DETAILED DESCRIPTION OF THE LATCHING MECHANISM

Figure 1:
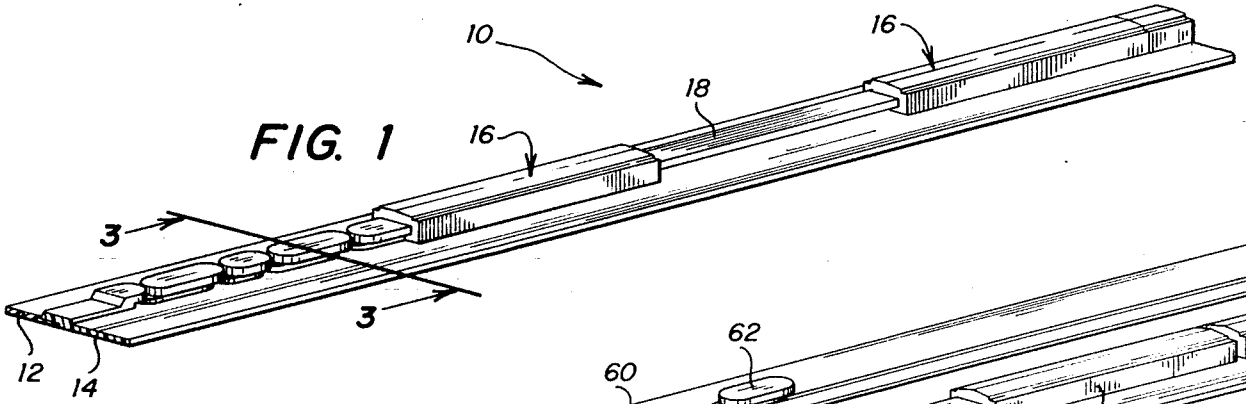
FIG. 1 is a perspective view of two structural members that are to be secured together in an edge-to-edge fashion, with one of two adjacent latching mechanisms being fully open.
Figure 2:
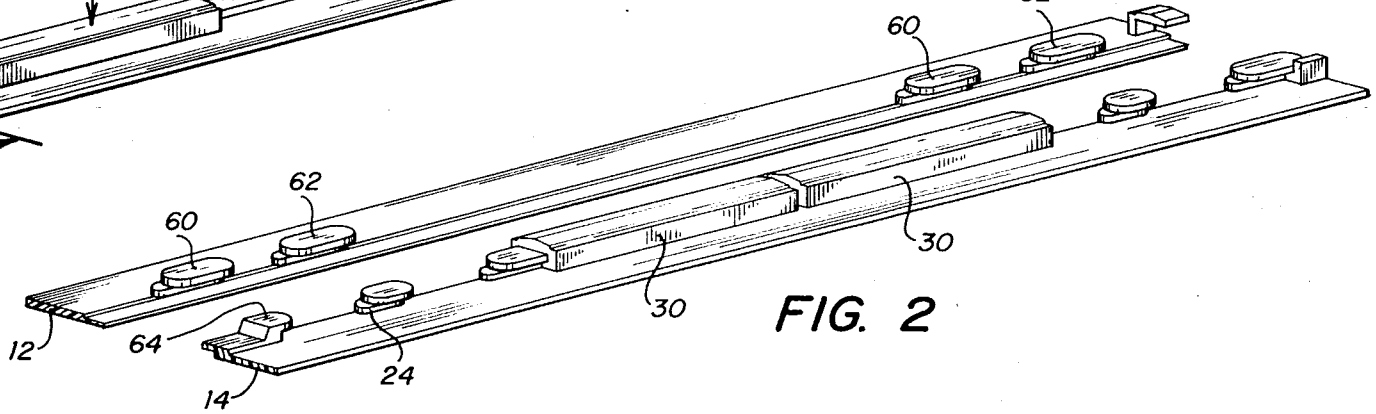
FIG. 2 is a perspective view similar to FIG. 1 but showing the two structural members slightly separated, in order to more clearly reveal which portions of a latching mechanism are carried by one structural member and which portions are carried by the other structural member.

A major feature of the container disclosed herein constitutes a slide-type latching mechanism which contributes many economies to the overall construction; and, attention will now be focused on the latching mechanism alone. Referring initially to FIG. 1, an exemplary container 10 is represented by first and second container portions 12, 14 which are relatively moveable between an open configuration and a closed configuration. Of course, when said first and second container portions 12, 14 are closed, they define a compartment for holding some object, covering some structure, or dividing some space, etc. In FIG. 1 there are two slide-type latching mechanisms 16 illustrated, one of which is shown in its fully closed mode and the other being in a fully open mode. Because of the proximity of the two latching mechanisms 16, the closed one is effective at holding body portions 12, 14 together; but, if the mechanisms 16 were spaced much further apart, there would presumably be no restraining force that would be holding the body portions 12, 14 together. And, to illustrate how said body portions 12, 14 would appear as they begin to separate from one another (i.e., after the latching mechanisms were released), FIG. 2 shows the same structural pieces that are visible in FIG. 1—but which are now separated by approximately one inch.

Figure 4:
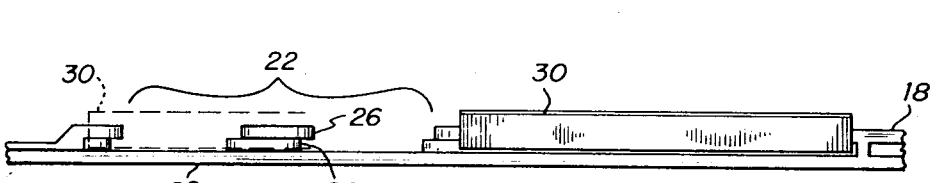
FIG. 4 is a side elevational view of one of the latching mechanisms shown in FIG. 1, with the slide being shown in solid lines to represent the latching mechanism in its open condition—and being shown partially in broken lines to represent the latching mechanism in its fully closed condition.
Figure 3:
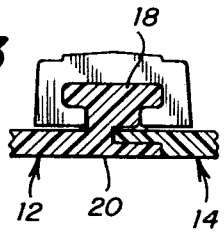
FIG. 3 is a cross-sectional view of the longitudinal rail, taken in the transverse plane indicated by numerals 3—3 in FIG. 1.

Referring additionally to FIGS. 3 and 4, a generally T-shaped rail 18 is mounted above a base 20, with the base obviously constituting a structural part of one of the portions that is to be connected by the latching mechanisms. The rail 18 is preferably elongated and lies along the boundary or edge of one of the parts that is to be connected. In the example of a gun or fishing rod case, the rail will also be linear; but it should be understood that the concept of this latching mechanism is not restricted to linear latches. Thus, the rail could be circular in shape, so as to form a container for something like a bowling ball or other sphere. Of course, if the rail is to be curved, the complementary slide should have a curvature or at least an internal cavity that matches the radius of the rail's curvature.

Referring particularly to FIG. 4, the rail 18 is interrupted by a gap 22; the length of this gap bears a very important relationship to the latching mechanism, but only in a relative sense—with respect to the length of the slide. That is, the absolute length of gap 22 is not critical, but a preferred length for something like a gun case is about $3\frac{3}{8}$ inches. A post 24 extends upwardly from the base 20 in approximately the center of the rail gap 22, and the post is aligned with the web of the rail. And, the post has a cap 26 that is sized and positioned so that the post and its cap have a cross-sectional appearance equivalent to that of the T-shaped rail 18. Expressed in other words, the cap 26 has a width and thickness which is essentially the same as that of the head of the rail 18, and the post 24 has a height and thickness that is essentially the same as the web of the rail 18. By aligning the post 24 with the rail's web, the post and its cap may effectively function as a geometric extension of the T-shaped rail. Besides its cross-sectional shape, the length of the cap 26 and its placement is also significant to the latching mechanism, but—again—not in an absolute sense; a preferred length is about $\frac{5}{8}$ inch long. With a rail gap 22 of about $3\frac{3}{8}$ inches long and a cap 26 about $\frac{5}{8}$ inch long, there will remain two openings along the rail of about $1\frac{1}{4}$ inches each, with one opening being on each side of the post 24.

If buttons are manually positioned in either or both of the openings adjacent post 24, and if a slide is moved so that it completely envelops the rail gap 22, anything (like the buttons) that is aligned with the rail will be securely captured and held by the slide. And anything that is firmly connected to the captured buttons (like a second container portion) will then become effectively held by the slide. However, in a very broad sense this particular type of construction cannot be described as being entirely new, because other slides are known which operate on the principle of holding together similarly configured elements with a channel or clamp. Examples of such slide mechanisms, in a very broad sense, can be found in U.S. Pat. No. 1,878,413 entitled "Fastening Device for Bags," and U.S. Pat. No. 3,317,076 entitled "Plastic Case," and U.S. Pat. No. 4,048,051 entitled "Box with Child Resistant Closure." However, insofar as can be determined from a careful reading of patents that disclose such slide-type latching mechanisms (including the three specifically mentioned above), no such mechanism has previously been taught in which the slide is captured and held upon its associated rail by virtue of an interdependence between certain spatial features of the slide and the inherent resilience of the slide and/or its associated rail. To explain this critical relationship, attention will now be directed to the combination of FIGS. 4, 5 and 6.

Figure 5:
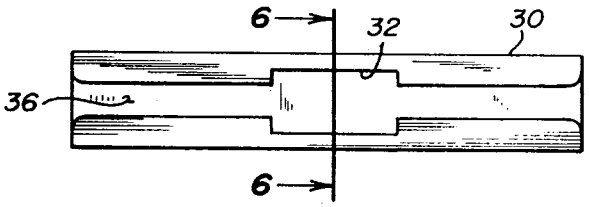
FIG. 5 is a bottom plan view of a slide in accordance with this invention which has been optimally configured so as to be bi-directional for assembly purposes, i.e., so that it may be installed with either end being initially engaged with the rail.
Figure 6:
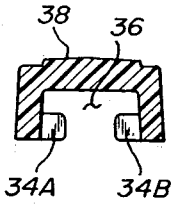
FIG. 6 is a cross-sectional view of the slide, taken in the plane represented by lines 6—6 in FIG. 5.

The rail gap 22 which is clearly visible in FIG. 4 is, of course, interrupted by a medial post 24 and cap 26; and, if something is to be inserted onto the rail 18 through the gap 22, there must be some allowance for the configuration and placement of cap 26. Turning next to FIG. 5, an elongated slide 30 has a transverse opening 32 which is sufficiently wide as to pass over the cap 26. Concurrently, the opening 32 is sufficiently wide as to pass over the head part of the T-shaped rail 18. Obviously, then, the wide opening 32 cannot extend for the full length of the slide, or there would be nothing holding the slide on a rail 18 so that it might function to hold a container closed. This necessary holding function is ensured by providing two flanges 34A, 34B which extend inwardly toward one another below a longitudinal cavity 36 that extends for the full length of the slide. In view of the fact that the cavity 36 opens downwardly into the bottom of the slide 30 (between the two spaced flanges 34A, 34B), and the cavity is solidly bounded on its top side by wall 38, the slide may be accurately described as having a transverse cross-section which is generally C-shaped. The C-shaped nature of the slide's cross-section will be more readily apparent from an examination of FIG. 6, which is a cross-sectional view taken in the plane represented by lines 6—6 in FIG. 5. The gap between the two flanges or lips 34A, 34B must, of course, be sufficiently wide as to accommodate the web portion of the T-rail as well as the width of the post; hence, the minimum size of this gap must be such as to foster sliding movement of the slide 30 with respect to the rail 18. The maximum size of the gap between the two flanges will be established by the degree of overlap that seems to be desirable between the head of the T-shaped rail and the two flanges. An overlap of about $\frac{1}{8}$ inch for each flange has been found to produce a highly satisfactory holding function, and it may be described as a preferred dimension.

Figure 7:
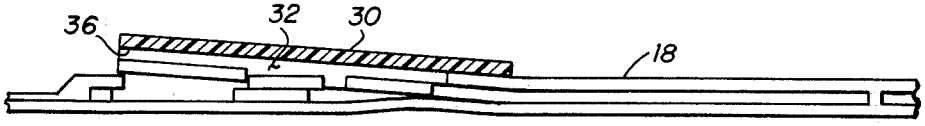
FIG. 7 is an elevational view of the latching mechanism showing the slide in the initial position that it has during the engagement of a slide and a rail at the time of manufacturing a latching mechanism, and illustrating the latching mechanism partially sectioned along its center line.
Figure 8:
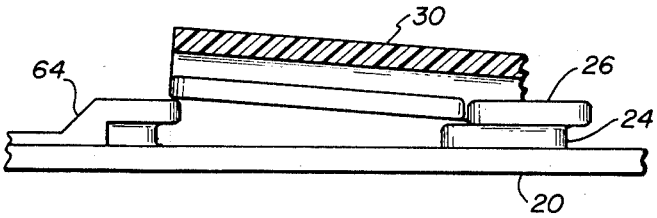
FIG. 8 is a fragmentary, partially sectioned elevational view of that portion of the slide which is critical to the installation of the slide on a rail.

Turning attention next to FIG. 7, the slide 30 is shown in a position where it can be easily placed by a worker during the process of installing the slide. The slide 30 is positioned so that one end of the longitudinal cavity 36 is aligned with the head of the T-rail 18 and, in fact, envelops a short length of the rail. This first end that is engaged with the rail will be referred to, for convenience, as the forward end of the slide, in order to have some frame of reference for some spatial relationships which will now be described. As the slide is moved forwardly, the rearmost end of the slide opening 32 will eventually come to bear against the back edge of cap 26, preventing further movement of the slide in a straight line. At this time, the length of the slide 30 prevents it from moving downward into full alignment with the T-rail. That is, the slide 30 has a length which is at least slightly greater than the length of the gap 22, and the slide's excess length prevents its rear end from moving downward into the gap 22. The extent of interference, that is, the excess length of the slide, can be largely a matter of choice—depending upon the materials which are utilized in the latch mechanisms and their inherent resilience, etc. When the T-rail 18 and its associated support (i.e., the base 20) are made of polypropylene having a good degree of resilience when warm, an interference at the rear corner of about 0.060 inch has been found to be particularly appropriate. To overcome this interference at the rearmost corner of the slide 30, it is necessary that the slide be moved forwardly; but before this can happen, it is necessary that two abutting faces—constituting the rear edge of opening 32 and the back end of cap 26—be shifted vertically. This shifting is represented by FIGS. 8 and 9, with FIG. 8 being the initial (interference) position of these parts, and FIG. 9 showing their spatial relationship at the time that slide 30 has just been "freed" in order that it might be pushed further onto the rail 18.

Soon after this forward movement of the slide 30 is resumed, the rear corner of the slide will clear the front edge of the rear segment of the rail, thereby allowing the rear end of the slide to drop into exact alignment with the T-rail. Once the slide 30 has become captured by the rail (and the post/cap), the memory of the temporarily deformed cap or base will typically cause it to return to its original configuration. Now, the excess length of the slide 30 with respect to gap 22 prevents the slide from moving upward with respect to the rail, while still permitting easy movement of the slide along the rail. Having become captured on the rail 18, the slide 30 will remain so captured until such time as a person exercises a significant degree of force to deform one or both of the appropriate structural members in order to reverse the installation step. As a practical matter, however, it is much easier to install a slide onto a properly proportioned rail (and its gap) than it is to remove such a slide. For all practical purposes, then, the slide may be considered to be securely captured, at least to the extent that it cannot be accidentally lost or dislodged. And, as suggested earlier when discussing other slide mechanisms, any buttons on a second structural body that are aligned with the T-rail and inserted in its gap will be securely held by an enveloping slide which is manually positioned to extend across gap 22.

Figure 9:
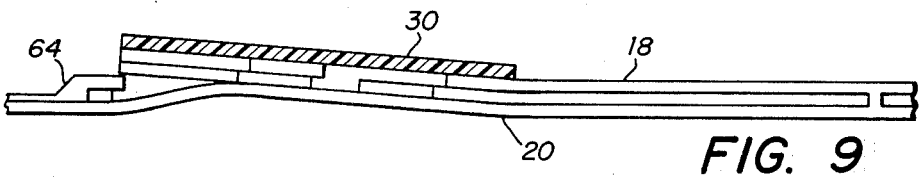
FIG. 9 is a view similar to FIG. 8 and showing the relative position of those parts which must be temporarily deformed in this particular embodiment in order to permit installation of the relatively rigid slide shown in earlier figures.

The relative position between slide 30 and post cap 26 in FIG. 9 can be achieved by causing either one or both of these elements to be temporarily deformed; that is, a relatively flexible slide could be pushed down or a relatively flexible post could be pushed up—in order to permit the cap 26 to become aligned with the internal cavity 36. It is generally preferred, however, that the slide 30 be relatively rigid, and that any distortion that is necessary to install the slide be completely accomplished within the post 24 and its cap 26 and its supporting base 20. When the latching mechanism 16 is employed on a large case that is suitable for carrying guns or fishing rods and the like, so that the length of the case is on the order of 48 inches, the preferred material for the base is a polypropylene resin formulated for injection molding applications by Northern Petrochemical Company (of Omaha, Nebr.) and marketed under the brand name NPP 8462 HR. This product is further described as a high flow, medium impact copolymer having a melt flow rate of 12.0. The thickness of the base immediately below the post is about 1/10 inch, and the base has a substantial unsupported length, so that it has sufficient flexibility to yield to an upward force on cap 26 during the installation of the slide 30. This is especially true when the appropriate slides 30 are installed on their respective rails 18 shortly after a case has been removed from a mold, so that the case material is still warm and relativley pliable.

When all of the necessary flexibility for slide installation is realized from the base 20 and/or the walls of a case, a preferred material for the slide 30 is a high-impact ABS thermoplastic material such as Cycolac T manufactured by Borg Warner Chemicals, Inc. Such a material is characterized by good dimensional stability and the kind of scratch resistance that is preferable for things which are routinely grasped with the hands, etc. When the resilience of a slide is essentially zero, it may be aptly described as substantially rigid.

Before discussing the container, per se, it will probably be appropriate to comment about some geometrical features of the T-shaped rail. As clearly shown in FIG. 3, the T-rail is symmetrical—as examined in its transverse cross section, and the web extends vertically upward and intersects the head at the middle thereof; hence, the head may be said to extend outwardly from the web by an equal distance on both sides of the web. And, while this symmetrical relationship is considered to be preferred for the rail, the invention should not be interpreted as being limited to only a symmetrical "T." Indeed, it would be entirely feasible for the web to intersect the head at essentially any spot—such that the rail's appearance, in cross-section, could conceivably be described as more nearly L-shaped rather than T-shaped. In such a case, the longitudinal cavity of a slide would be similarly altered so as to complement the shape of a modified rail, keeping in mind that the slide should not have such a loose fit around a rail that it could fall off the side of the rail. Of course, planned clearances and tolerances can be more generous when the rail is a symmetrical "T" (because there is a stronger "mechanical interlock" between the rail and the slide), so it naturally is the preferred configuration. But as long as the rail is non-planar and the slide has an internal cavity whose transverse cross section complements the cross section of the rail, the principles described herein should be serviceable to provide the desired results.

Another feature of the preferred embodiment of the rail is revealed in FIG. 7, wherein a vertical offset is visible in the boundaries of the two spaces adjacent post 24. That is, the top of the post (cap 26) is not placed directly over its lower section, with the result that there is an overhanging ledge that extends forwardly from the post 24. The rear end of the leading portion of the rail 18 has a similar offset but in the opposite direction, so that it appears somewhat like a stairstep. When structural means such as posts or buttons (on the body to be secured by the latch) are shaped to complement these irregular shapes, longitudinal movement of the slide 18 into its latching position over the rail gap 22 is easier. That is, the interlocking and overlapping features of the structural elements on two separable bodies more readily assures that the slide can be moved smoothly over the juxtaposed elements. The significance of this intermeshing configuration will perhaps be better appreciated when it is remembered that the object that is to be protected within the container will sometimes be tightly held in place by foam cushions; and these foam cushions will often be under compression when the container sides are closed toward the object, which naturally tends to bias the two container sides away from their closed configuration. So, if an internal cushioning material is acting to force latch components apart (in a transverse direction), it is advantageous to configure adjacent latch elements so that longitudinal engagement of the slide in moving over those elements is fostered.

One other facet of the offset post 24 is that it helps hold together the two structural pieces that are to be joined by the latch, even before the slide is pulled backward over the rail gap. That is, a button or other structural means that fills the rail gap will naturally be precluded from moving longitudinally, both forwardly and rearwardly—by the rail; and it will be precluded from moving upwardly by the offset top of the post 24. So, even before the slide 30 is moved to its latching position, the intermeshing of the post, rail and structural means holds the two bodies against movement in at least two directions; and, after the slide is moved backward so that it at least partially covers the gap, transverse movement in a withdrawal or "container opening" direction is also precluded.

Perhaps it should also be mentioned at this point that the rail and any cooperating buttons do not necessarily have to be integrally formed with a major structure such as the wall of a container. If desired, a T-shaped rail could be molded onto a narrow base, and the base could then be attached to the edge of most any kind of structure; a set of matching buttons would then be molded at the correct locations on a separate strip. The base/rail unit and the strip of buttons could then be sold as a matching pair—just like both sides of a zipper are sold together at a sewing center or the like. If someone then wished to have a sliding latch which holds together two sheets of planar material in an edge-to-edge fashion, he would only need to attach the rail and its associated slides to the edge of one sheet, and attach the series of buttons at the appropriate location on an edge of the other sheet. An attractive latching mechanism would then be available for holding the two planar pieces together for as long as seems to be desirable.

DETAILED DESCRIPTION OF THE CONTAINER

Figure 10:
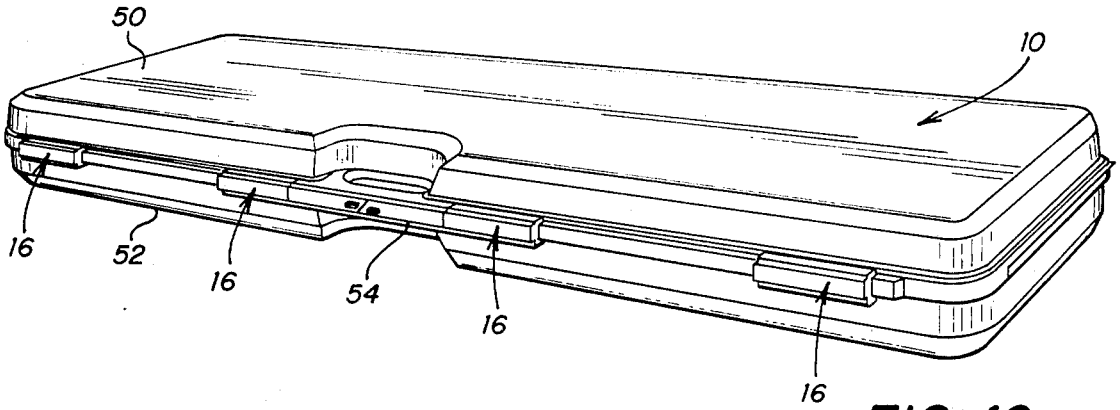
FIG. 10 is a perspective view of an exemplary container having two identical halves that are positioned in a face-to-face manner.

Assuming that a latching mechanism as described above is to be utilized on a gun case or the like, it will be advantageous to mold the rail 18, post 24 and matching buttons as integral parts of a molded plastic case. And, by virtue of the judicious placement of the rails 18, gaps and buttons, etc., it is possible to utilize a single die for the manufacture of one half of a gun case. By taking two such halves, orienting them so that they are 180 degrees apart and placing them face to face, they may be joined along one edge with a hinge pin in order to define a closeable container. Turning next to FIG. 10, such a container 10 comprises a first container portion 50 and a second container portion 52, which portions are relatively movable between an open and a closed configuration, and which define a compartment therebetween when they are closed. The container portions 50, 52 each have first edges which are juxtaposed when the compartment is closed, and said edges are separated when the compartment is open. Ideally, the first edges overlap one another at least partially when the container is closed, in order to minimize the possibility of any dirt or other contaminant getting into a closed compartment. A rail (such as rail 18, previously described) is affixed to the first edge of a container portion 50 between one end of the container and a central handle 54. Between said handle 54 and the other end of the container portion 50 are pairs of buttons which are placed so as to fit into the spaces on either side of an associated post 24. Such buttons are present but concealed when the container is closed as shown in FIG. 10, so reference to FIGS. 1 and 2 will perhaps be necessary to see how they are placed on an edge of a container portion. These buttons 60, 62 are configured similarly to the post 24 which creates the two nearby gaps in rail 18, in that they have a transverse cross section which is like that of rail 18, and in that they have rounded corners—as seen in a plan view. Certain ones of the rounded corners of post 24 and buttons 60, 62 make it easier to align and bring the two container portions together during closure of the container; and other rounded corners facilitate longitudinal movement of the slide 30 as it is being moved to an enveloping position.

In the situation where a container is to be long enough to hold a rifle or shotgun (e.g., at least 48 inches), it is advantageous for a slide closure means to be relatively long. That is, a slide closure means which is, say, about 4 inches long will be advantageous because it will help distribute the holding force over a greater length of the container's confronting edges. And, by using four such slide-type latching mechanisms on the container 10, the holding forces tending to keep the container closed may be distributed in an approximately uniform fashion from one end of the container to the other. Also, it is advantageous to arrange the rails and their associated gaps and end stops so that the slide 30 must be installed in opposite directions, with the result that the respective directions of slide movement in order to achieve latching are also opposite. Hence, any vibration of a container that might somehow tend to open one slide would only tend to tighten the other slide. In practice, though, unwanted slide movement has never been found to be a problem with containers made in accordance with this invention.

Turning again to the central handle 54, it will noted that it is centrally positioned with respect to the container 10 and is aligned with the rail 18. It is also sized (as well as positioned) so as to serve as a stop at one end of the rail, so as to preclude loss of the slide 30 off that end of the rail. Another stop 64 is provided at the other end of the rail 18, so that any slide that is engaged with the rail will be held thereon, as long as the rail is maintained straight. If a person should want to deliberately remove a slide 30, the rail 18 need only be temporarily deformed to the extent that a slide 30 can be forced out of any gaps which exist for installing a slide. One advantage of this particular configuration is that a damaged slide can be removed and discarded—and replaced with a new slide without the need for any skilled labor or exotic tools. So, if the owner of a container should accidentally lean it against a hot stove and thereby damage a slide, restoring the container to like-new condition can be accomplished in a matter of a few seconds.

Figure 11:
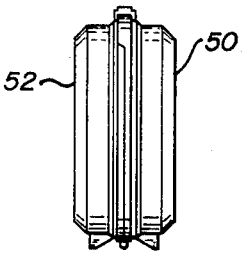
FIG. 11 is an end, elevational view of the container shown in FIG. 10, with the container being fully closed.
Figure 12:
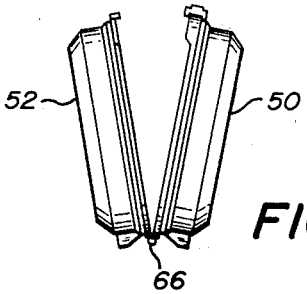
FIG. 12 is an end view of the container of FIG. 10 and showing it partially opened by virtue of movement of the two halves about the hinge line along its rear edge.

Turning specifically to FIGS. 11 and 12, the two container portions 50, 52 are shown in a face-to-face position, which is accomplished by taking two sequentially molded pieces and turning one of them by 180 degrees so that it faces the other. By providing a rail 18 and its associated gaps on one side of a center line through the container, and providing buttons that are sized and shaped to fit within the rail gaps on the other side of the container's center line, turning one of the units by 180 degrees will permit both sets of rails and buttons to interlock. And, if the appropriate slides 30 have been properly installed on the respective rails 18 before the two container portions 50, 52 are brought together, then longitudinal movement of the slides 30 so as to capture the buttons 60, 62 will hold those container portions 50, 52 securely together.

Figure 13:
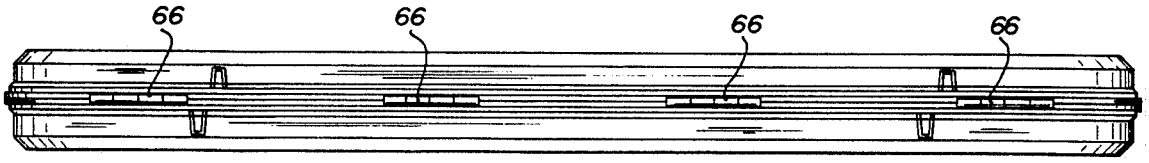
FIG. 13 is a rear elevational view of the container of FIG. 10, shown in its closed configuration.

The hinge pins 66 which are visible in FIGS. 12 and 13 are probably the only structural pieces of a container 10 which are appropriately made of metal; and, if necessary, even these hinge pins could be made of a plastic or other non-corroding material. As a result, the container disclosed herein is particularly appropriate for holding equipment which is subjected to a corrosive atmosphere—including salt spray and the like. Unlike some other containers for fishing rods, etc., a container molded from a resin like the previously described Norchem polypropylene resin can be made relatively immune to attack from corrosive atmospheres; and, by integrally molding the latches, hinges and a handle, the container can be fabricated with a minimum amount of assembly labor.

While only the preferred embodiments of the invention have been disclosed herein in great detail, it will be apparent to those skilled in the art that modifications thereof can be made without departing from the spirit of the invention. Thus, the specific structure shown herein is intended to be exemplary and is not meant to be limiting, except as described in the claims appended hereto.

What is claimed is:

1. A container, comprising:

(a) first and second container portions which are relatively movable between an open configuration and a closed configuration, and the container portions cooperating when they are in a closed configuration to define a compartment, and the container portions having first edges which are juxtaposed when the compartment is closed and separated when the compartment is open;

(b) a rail fixed to the first edge of a first one of the container portions, said rail extending linearly along said edge for a significant length but being interrupted by two adjacent gaps;

(c) a pair of posts fixed to the first edge of the second container portion and positioned so as to be insertable within the two rail gaps when the two container portions are in their closed configuration, and said posts having a transverse configuration which matches the transverse configuration of the rail, whereby said posts may be described as forming geometric extensions of the rail when the two container portions are closed; and (d) the first and second container portions being configured identically and each portion having both a rail at one location and a pair of posts at another location, and wherein the container portions are oriented during assembly of the container so that they are 180 degrees apart, and the first and second container portions having second edges which are permanently joined together with at least one hinge pin, and the posts affixed to one container portion are located at one end of the container and the posts affixed to the other container portion are located at the opposite end of the container; and (e) slide closure means mounted on the first and second container portions so as to be carried thereby at all times, and said slide closure means having an interiorly facing opening adapted for engaging said linear rail and for being captured by said rail, and said slide closure means having an interior configuration which is slightly larger than the transverse cross section of the rail so as to be slideable along the rail, and said slide closure means having a first position at which the pair of posts are free to move transversely with respect to the rail such that the two container portions may be opened, and the slide closure means being movable to a second position at which it completely envelope the two posts and at least a portion of the rail, whereby the slide closure means may preclude opening of the container by virtue of preventing transverse movement of the posts with respect to the rail.

2. The container as claimed in claim 1 wherein there is a rail and a slide closure means associated with each end of the container, and the two slide closure means are oriented in opposite directions, such that one slide closure means is moved in a first direction in order to be latched and the other slide closure means is moved in the opposite direction in order to be latched, whereby any vibration that might tend to open one slide closure means would also tend to tighten the other slide closure means.

3. The container as claimed in claim 1 and further including a central handle which is positioned so as to be adjacent to and aligned longitudinally with the rail, and the handle being configured so as to constitute an approximate extension of the rail but being sized so as to serve as a stop at one end of the rail, said stop being effective to preclude loss of the slide closure means off the adjacent end of the rail.

4. The container as claimed in claim 1 wherein the slide closure means is installable on and removable from its associated rail only by temporarily deforming the rail, and wherein the slide closure means is permanently captured by the rail as long as the rail is maintained straight.

5. A slide-type latching mechanism, comprising the combination of:

(a) a non-planar rail affixed to a base, and the rail being interrupted by a gap and the gap being sufficiently long as to receive a slide, whereby the slide and rail may become engaged so as to hold the slide on the rail but permit relative movement of the slide with respect to the rail;

(b) an elongated slide having a length which is at least slightly greater than the length of the gap in the rail, and the slide having a longitudinal cavity that opens downwardly into the bottom of the slide, and the cavity being partially bounded by at least one locking element that is configured and positioned so as to establish in the slide a transverse cross-section which complements the cross section of the non-planar rail, and the bottom of the slide having a short and centrally located transverse opening that is as wide as the top of the rail;

(c) a post extending upwardly from the base at approximately the center of the rail gap, and the post being configured so that it functions as a geometric extension of the rail;

(d) the rail and the slide constituting two structural members having an inherent resilience, and the resilience of at least one of said two members being sufficient as to permit temporary deformation in order that one end of the slide may be inserted into the rail gap and the slide may be positioned so that its transverse opening may be juxtaposed with and envelop the post, and the memory of the temporarily deformed member being such as to cause it to return to its original configuration after the slide has been forced into engagement with the rail, whereby the slide may become captured so as to envelop the rail and be slidable therealong;

(e) structural means for filling at least a portion of the rail gap when the captured slide has been moved longitudinally along the rail and away from the rail gap, and said structural means having an external shape which permits it to fit within the longitudinal cavity of the slide, and said structural means being captured and held by the slide when the slide has been subsequently moved to a latching position wherein it rests over the rail gap, whereby anything that is fixed to said structural means will be held adjacent the base when the slide is moved to its latching position over the structural means; and (f) the post in the center of the rail gap having a top that is offset in a longitudinal direction with respect to the lower portion of the post, such that the vertical face of the post is not linear, whereby any structural means that matches the configuration of the post and fills the rail gap will be secured against movement in at least two directions along different axes before the slide is moved to its latching position and secured against movement in three directions after the slide is moved to its latching position.

6. The slide-type latching mechanism as claimed in claim 1 wherein the rail has a transverse cross section which is shaped generally like a T, and the longitudinal cavity of the slide is generally C-shaped in its transverse cross section.

7. The slide-type latching mechanism as claimed in claim 1 wherein the T-shaped rail is substantially symmetrical by virtue of having a web that rises upward from the base and intersects the rail's head at substantially the midpoint thereof, whereby the mechanical restraining capability of the T-shaped rail with regard to the slide is essentially the same to either side of the rail.

8. The slide-type latching mechanism as claimed in claim 1 wherein the slide is characterized by substantial stiffness and the rail is characterized by much more resilience than the slide, whereby the rail is temporarily deformed much more than the slide during installation of said slide onto the rail.

9. The slide-type latching mechanism as claimed in claim 1 wherein the slide has a resilience that is so low that the slide may be considered to be essentially rigid, and the rail and its supporting base are sufficiently flexible as to provide all of the temporary deformation that is necessary to permit a rigid slide to be inserted into a gap that is shorter than the slide.

10. The slide-type latching mechanism as claimed in claim 1 wherein the transverse opening in the bottom of the elongated slide is located and sized so that the slide may be inserted into the rail gap with either end first, whereby the slide may be described as bi-directional when it is being positioned over the post during installation.

* * * * *